US009713404B2

(12) United States Patent
Hessler

(10) Patent No.: US 9,713,404 B2
(45) Date of Patent: Jul. 25, 2017

(54) PERSONAL HYGIENE DEVICE

(71) Applicant: Janet A. Hessler, Woodbridge, VA (US)

(72) Inventor: Janet A. Hessler, Woodbridge, VA (US)

( * ) Notice: Subject to any disclaimer, the term of this patent is extended or adjusted under 35 U.S.C. 154(b) by 5 days.

(21) Appl. No.: 14/824,554

(22) Filed: Aug. 12, 2015

(65) Prior Publication Data

US 2017/0042387 A1 Feb. 16, 2017

(51) Int. Cl.
*A47K 7/02* (2006.01)
*B25G 1/10* (2006.01)

(52) U.S. Cl.
CPC ..... *A47K 7/028* (2013.01); *B25G 1/102* (2013.01)

(58) Field of Classification Search
CPC ..... A47K 7/028; A47K 7/08; A47K 7/06
See application file for complete search history.

(56) References Cited

U.S. PATENT DOCUMENTS 3,297,031 A * 1/1967 Bray ..... A61M 31/007 604/218
5,664,281 A 9/1997 Pelfrey
5,671,497 A 9/1997 Abdo
5,960,509 A 10/1999 Wu
6,026,535 A * 2/2000 Lankowski ..... A45D 34/04 15/144.1
6,689,224 B1 * 2/2004 Hillman ..... A47K 7/06 134/6
2002/0124340 A1 9/2002 Nolan
2009/0093743 A1 * 4/2009 Corzine ..... A47K 7/028 601/136
2010/0034573 A1 * 2/2010 Moyers ..... A46B 5/0033 401/6
2013/0247320 A1 * 9/2013 Bayham ..... A47K 7/028 15/145
2014/0060576 A1 * 3/2014 Nelson ..... A47K 7/08 134/6
2014/0137352 A1 5/2014 Golla et al.

OTHER PUBLICATIONS

International Search Report and the Written Opinion of the Searching Authority dated Nov. 17, 2016, in connection with corresponding International Application No. PCT/US2016/045491 (14 pgs.).

* cited by examiner

*Primary Examiner* — Shay Karls
(74) *Attorney, Agent, or Firm* — Maier & Maier, PLLC

(57) ABSTRACT

A personal hygiene device may be provided. An exemplary personal hygiene device may include an elongated member having a handle section, a spacing section, and an attachment section. The sections of the personal hygiene device may be integrally formed or may be rotatably connected. A variety of attachments may be affixed to the attachment section of the personal hygiene device.

9 Claims, 6 Drawing Sheets

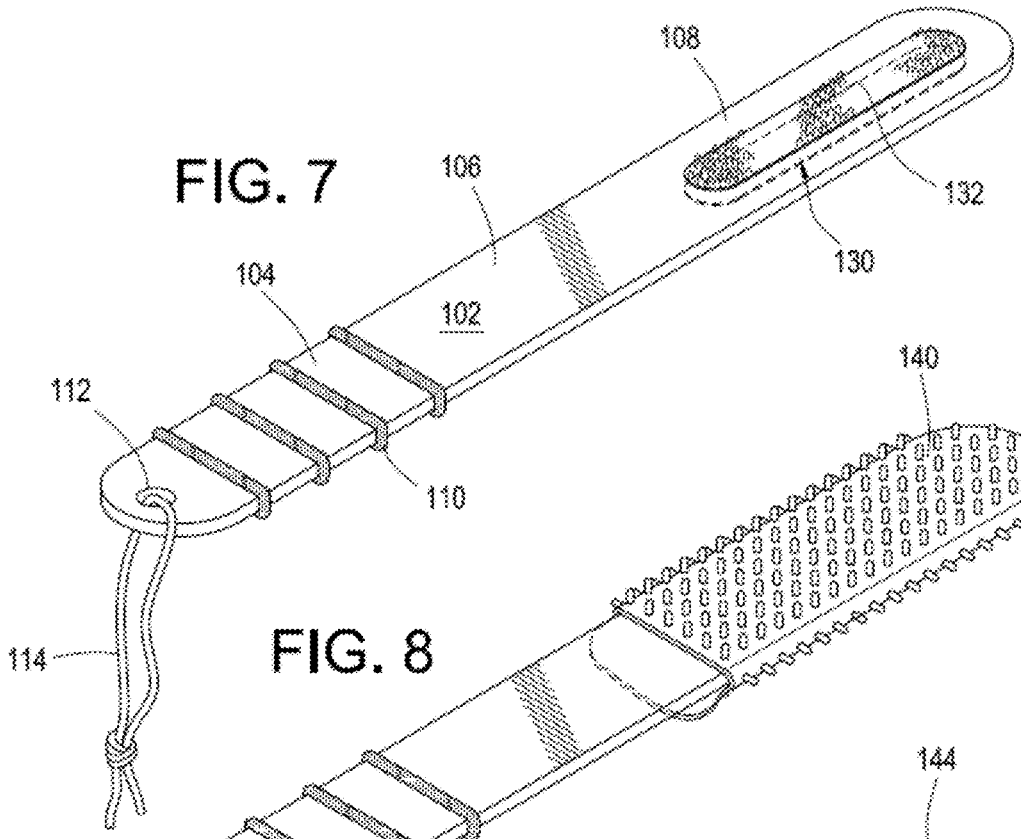
FIG. 7
FIG. 8
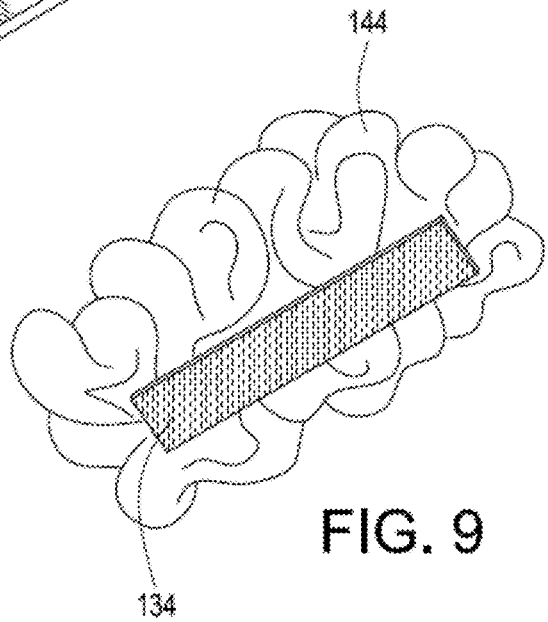
FIG. 9
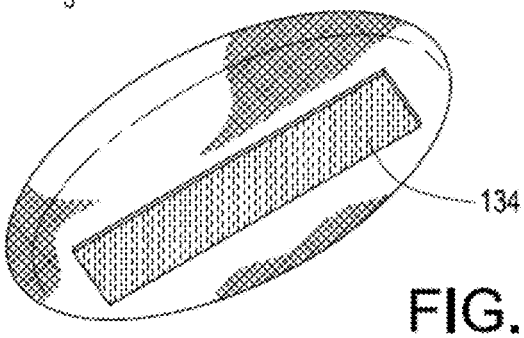
FIG. 10

FIG. 11
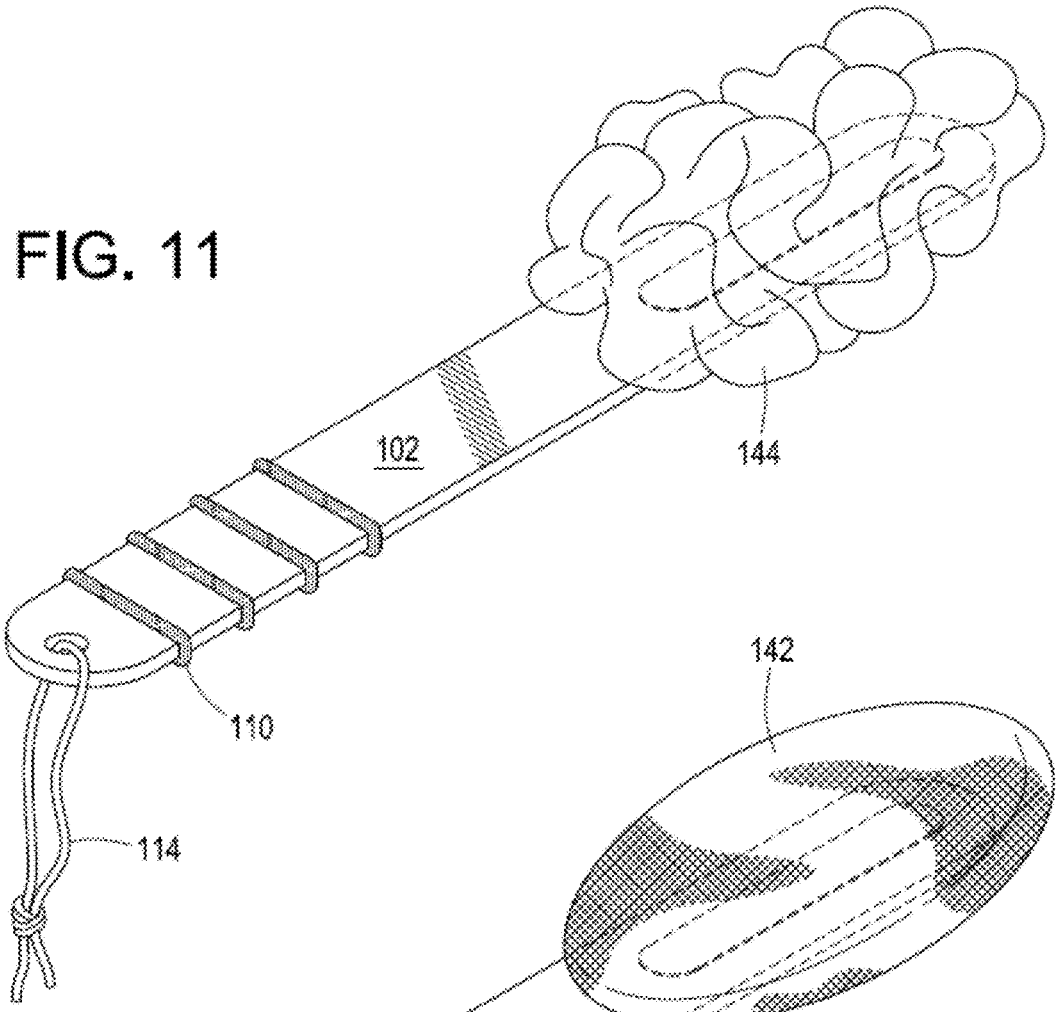
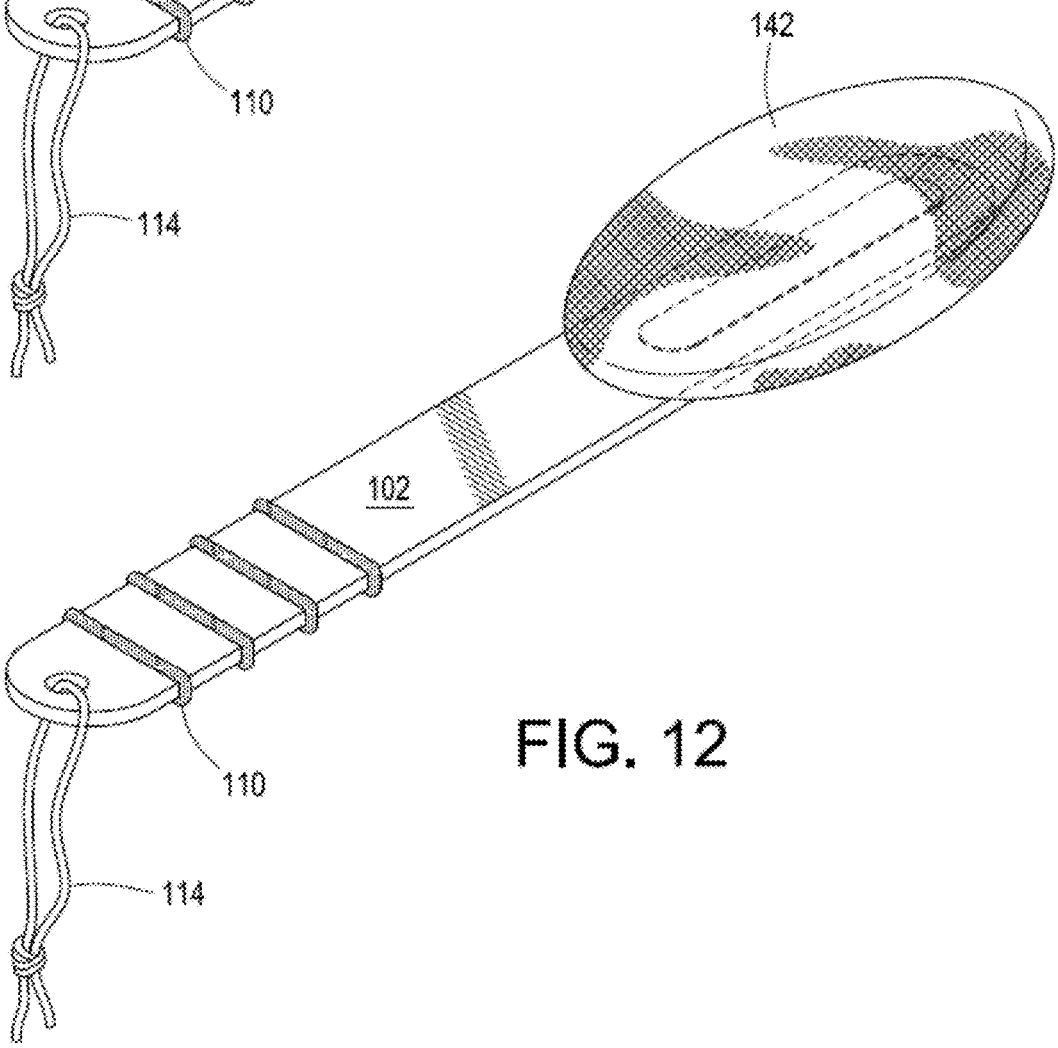
FIG. 12

PERSONAL HYGIENE DEVICE

BACKGROUND

Independently maintaining personal hygiene may be difficult for individuals in a variety of circumstances. It may be particularly difficult for certain individuals, such as handicapped individuals, to maintain hard to reach areas of the body. Maintaining personal hygiene is typically considered a private matter and can cause discomfort and anxiety when an individual must rely on others for assistance. It may be desirable to have a personal hygiene independence tool capable of facilitating a variety of hygiene related tasks.

SUMMARY

According to an exemplary embodiment, a personal hygiene device may be provided. The personal hygiene device may include an elongated member having a handle section, a spacing section, and an attachment section. A grip may be disposed on the handle section and a wrist strap may be secured to the handle section. A fastener may be disposed on the attachment section and may be used for attaching a hygiene material or attachment. The fastener may include a clip, adhesive, or hook-and-loop fastener. The handle section and spacing section may be rotatably connected and locked into position by a first hinge and the spacing section and attachment section may be rotatably connected and locked into position by a second hinge.

BRIEF DESCRIPTION OF THE FIGURES

Advantages of embodiments of the present invention will be apparent from the following detailed description of the exemplary embodiments. The following detailed description should be considered in conjunction with the accompanying figures in which:

Exemplary FIG. 1 may show a personal hygiene device;

Figure 2:
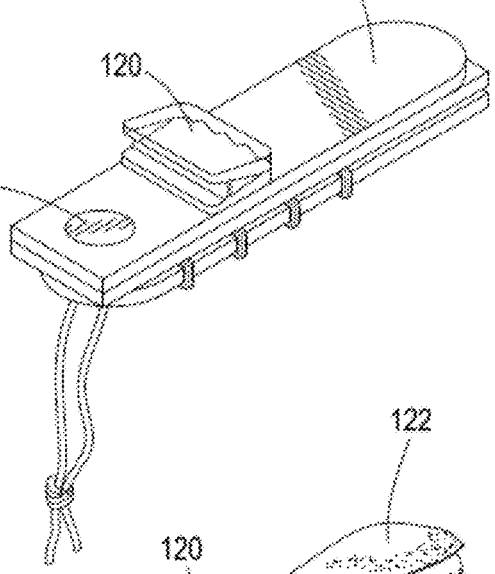
Figure 3:
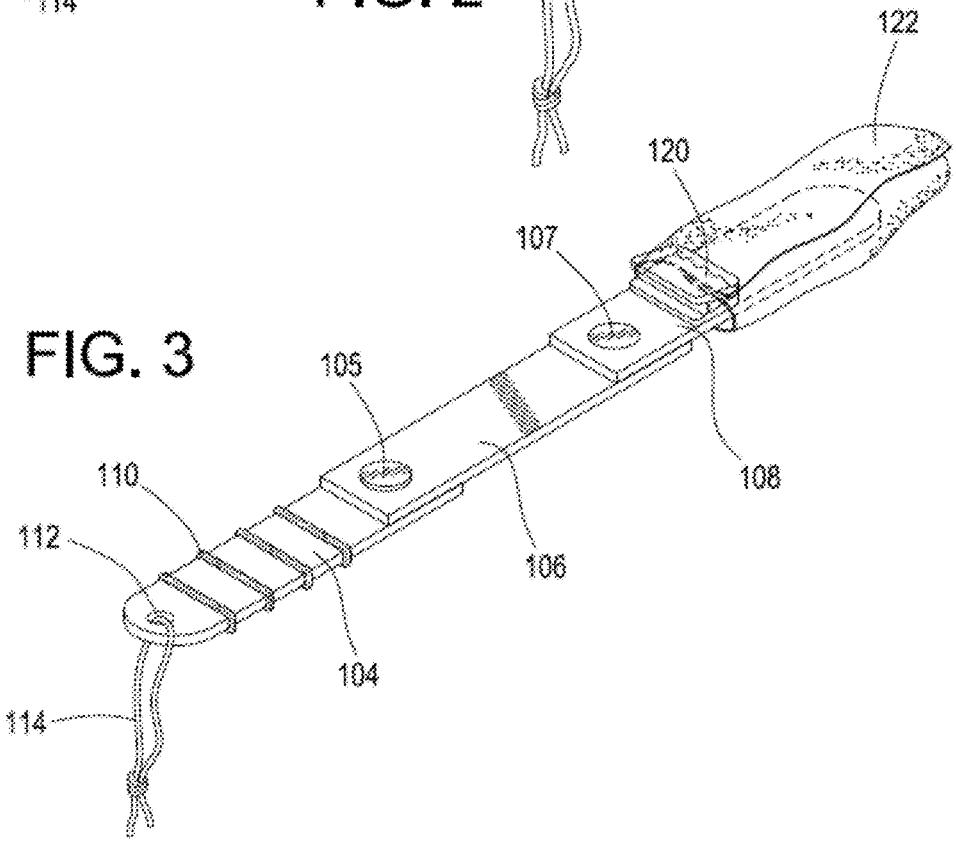
Figure 4:
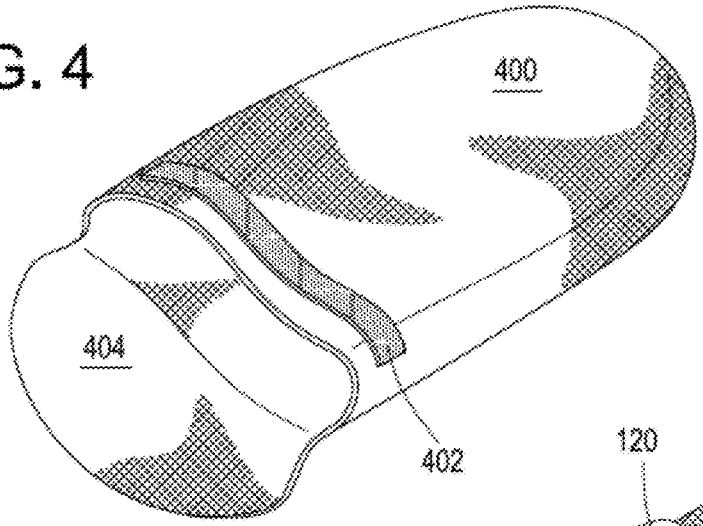
Figure 5:
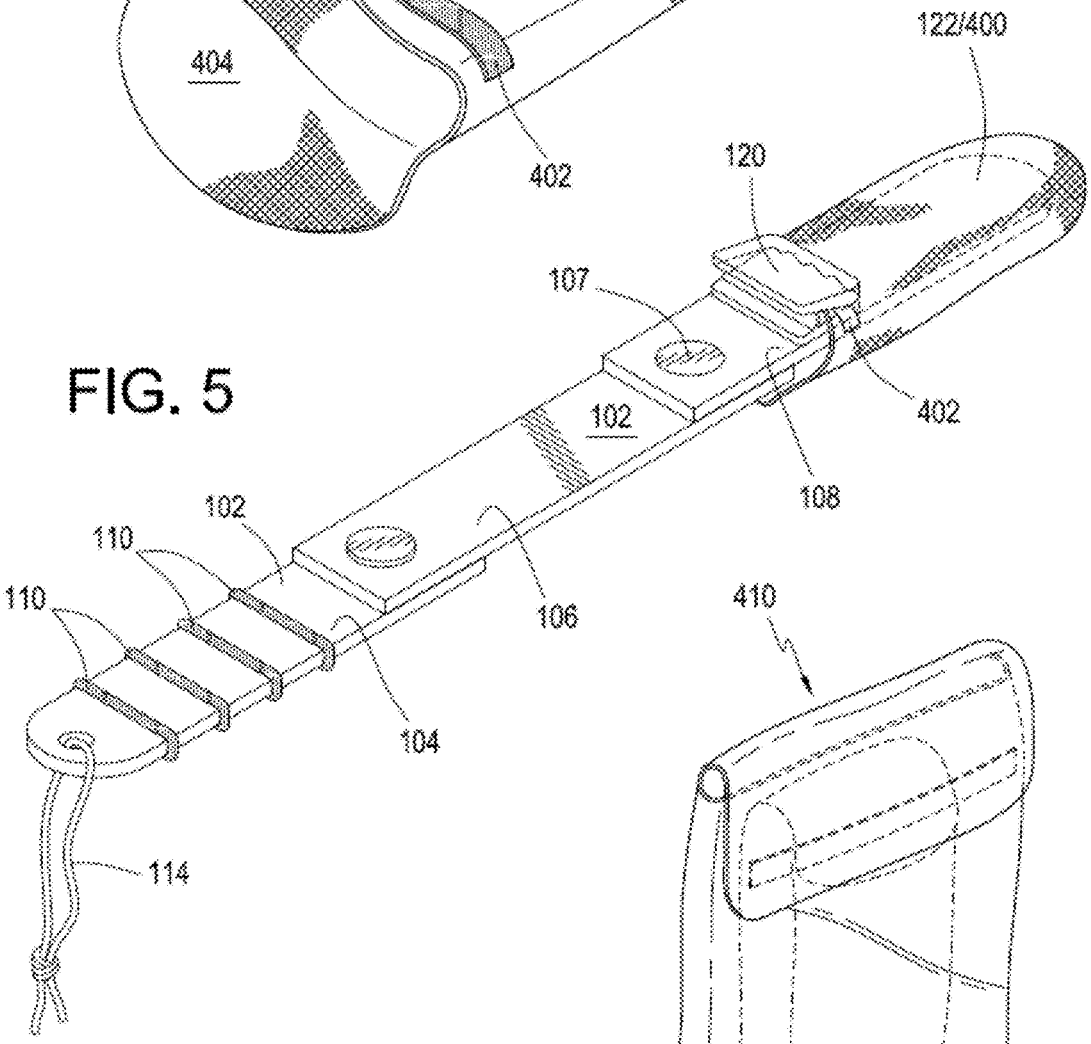
Figure 6:
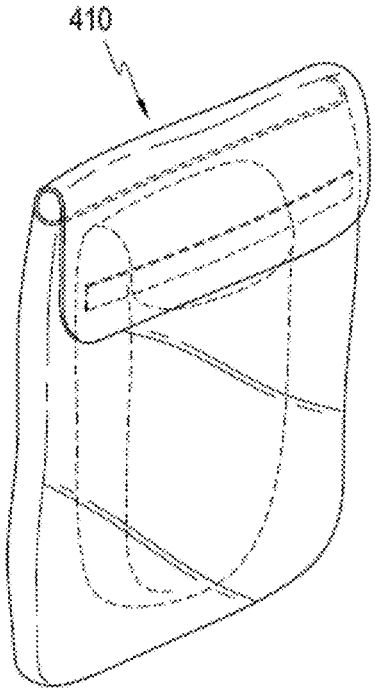
Figure 13:
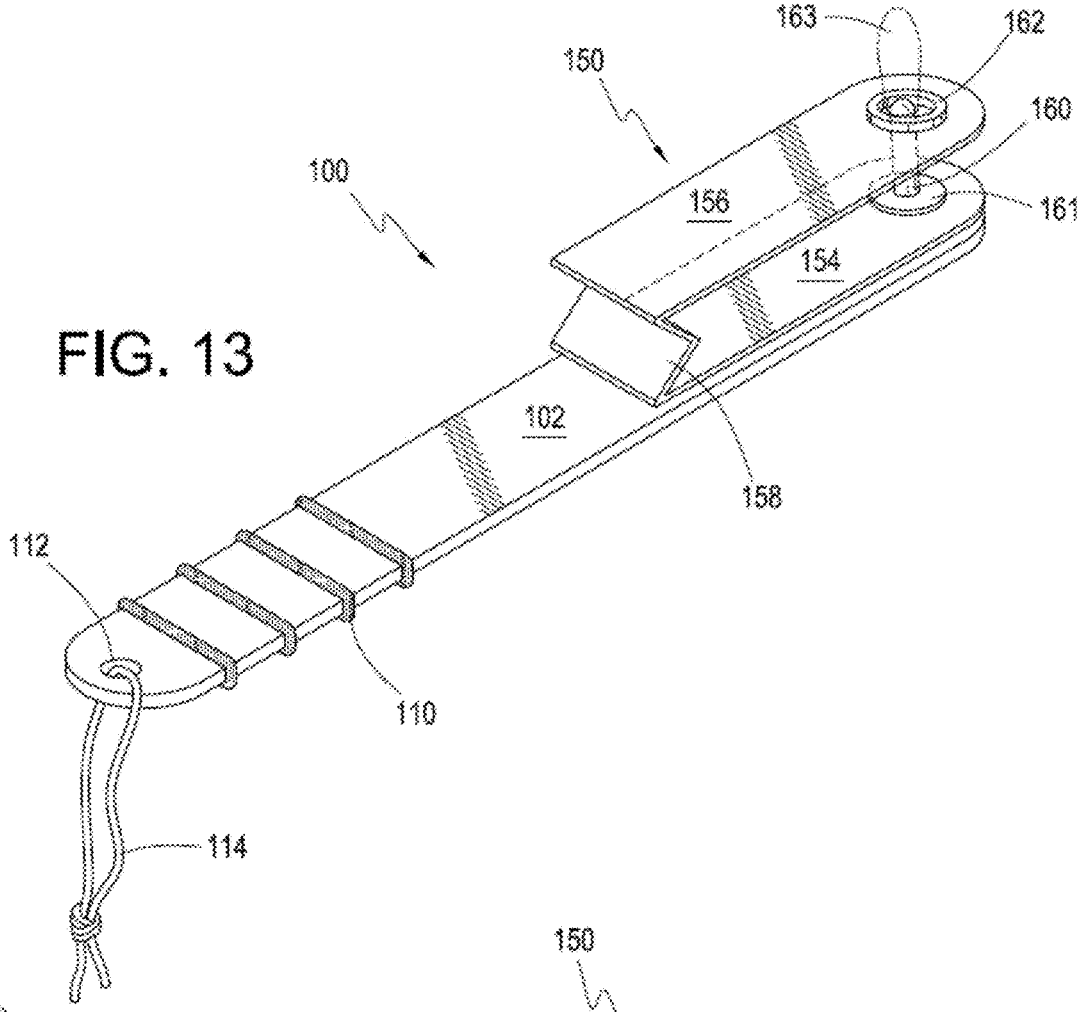
Figure 14:
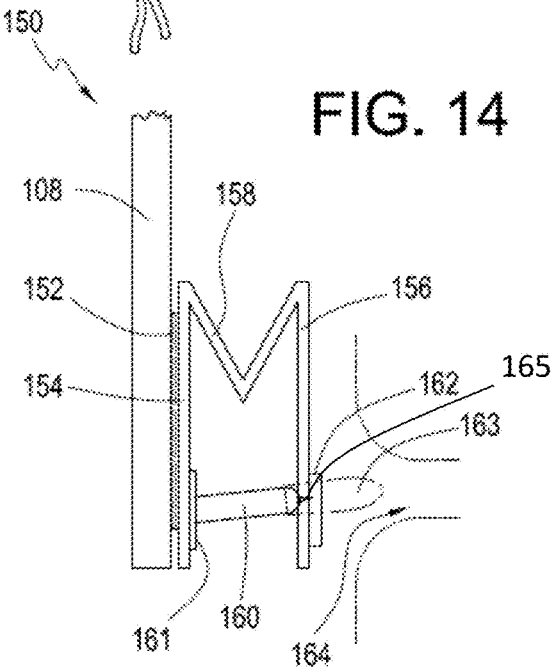
Figure 15:
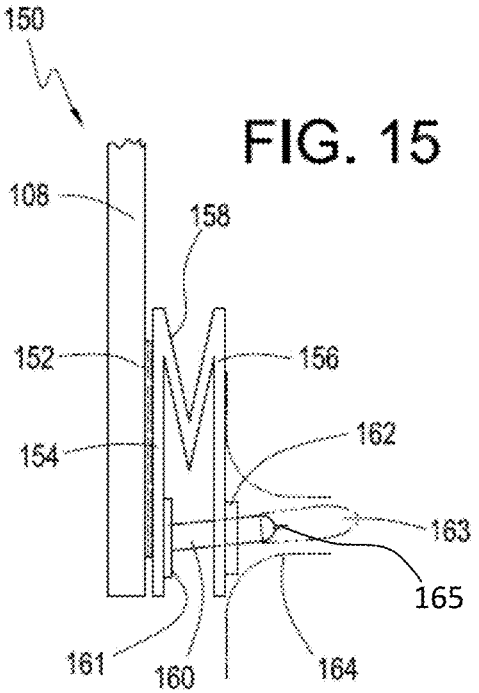
Figure 16:
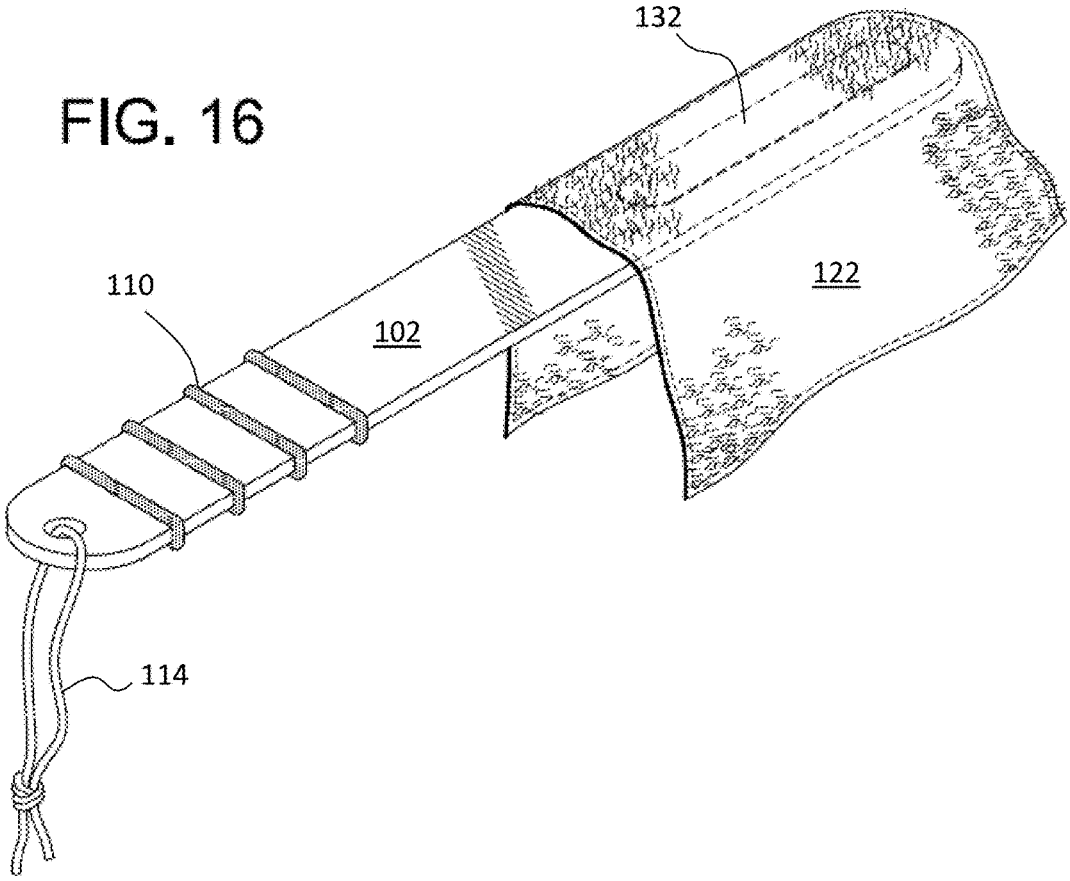
Figure 17:
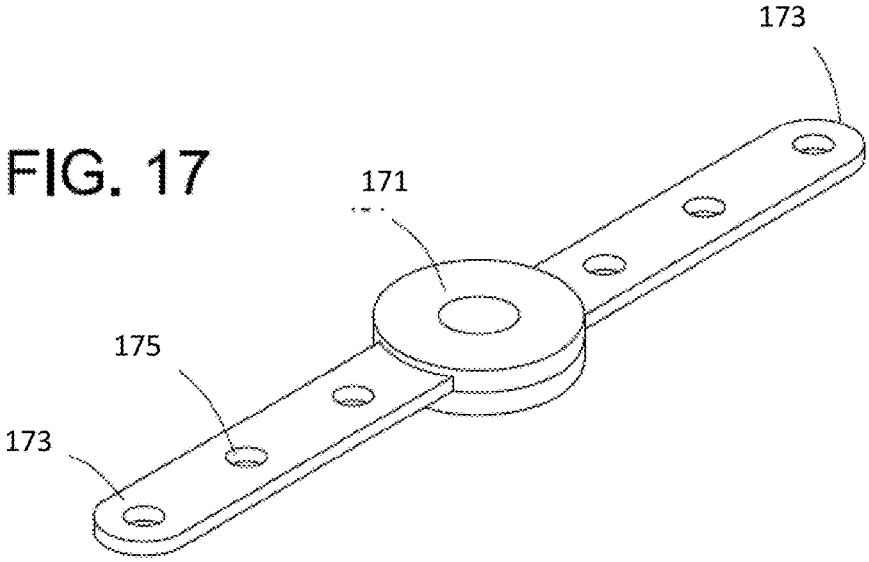

Exemplary FIG. 2 may show a personal hygiene device in a folded orientation;

Exemplary FIG. 3 may show a personal hygiene device with a desired material attached;

Exemplary FIG. 4 may show a tissue sleeve for use with a personal hygiene device;

Exemplary FIG. 5 may show a tissue sleeve attached to a personal hygiene device;

Exemplary FIG. 6 may show a tissue sleeve pouch;

Exemplary FIG. 7 may show a personal hygiene device;

Exemplary FIG. 8 may show a personal hygiene device with an attachment;

Exemplary FIG. 9 may show a personal hygiene device attachment;

Exemplary FIG. 10 may show an alternative personal hygiene device attachment;

Exemplary FIG. 11 may show a personal hygiene device with an attachment;

Exemplary FIG. 12 may show a personal hygiene device with an alternative attachment;

Exemplary FIG. 13 may show a personal hygiene device with a suppository insertion device attachment;

Exemplary FIG. 14 may show a suppository insertion device attached to a personal hygiene device;

Exemplary FIG. 15 may show a suppository insertion device in a collapsed position attached to a personal hygiene device;

Exemplary FIG. 16 may show a personal hygiene device with a further alternative attachment; and Exemplary FIG. 17 may show an alternative hinge for a personal hygiene device.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a personal hygiene device 100 may be disclosed. In an exemplary embodiment, a personal hygiene device may include an elongated member 102 having a handle section 104, a spacing section 106 and an attachment section 108. Elongated member 102 may be made of wood, plastic, metal, polymer, ceramic, or any other comparable material as would be understood by a person having ordinary skill in the art. In some embodiments, member 102 may be substantially rigid to allow for appropriate pressure to be applied through the device, as would be understood by a person having ordinary skill in the art. Member 102 may further be dyed, painted, printed, or wrapped with desired ornamentation or color. All edges of member 102 may optionally be rounded, dull, and/or smooth to the touch. Further, the number of holes, cavities, or crevices may be minimal to reduce the spread of bacteria, such as *Ecoli*, as would be understood by a person having ordinary skill in the art. In at least one embodiment, the handle section 104 may include a grip 110 for secure, comfortable handling. In some embodiments having a grip 110, the grip 110 may include at least one rib disposed on a surface of handle section 104. Grip 110 may be made of rubber or a comparable grip material. In alternative exemplary embodiments, the grip may optionally include indents, protrusions, or various surface textures. Handle section 104 may further include a connection or hole 112 for securing a wrist strap 114. A wrist strap may be a ribbon or cord capable of slipping over the wrist of a user to prevent dropping the personal hygiene device 100 during use.

In some exemplary embodiments, as shown in exemplary FIGS. 7-16, the handle section, spacing section, and attachment section may be sections of an integrally formed, solid elongated member 102. In other embodiments, as shown in exemplary FIGS. 1-6, the handle section 104 and spacing section 106 may optionally be rotatably connected by a hinge 105. The spacing section 106 and attachment section 108 may also optionally be rotatably connected by a hinge 107. Optional hinges 105, 107 may allow the personal hygiene device to be folded to adjust the orientation of device 100 as desired for use. This may allow for better access to difficult areas. Hinges 105, 107 may also be capable of locking in a desired orientation. Personal hygiene device 100 may be used when at least one of sections 104, 106, 108 is oriented at an angle other than 180 degrees from an adjacent member. In some embodiments, hinges 105, 107 and the size and shape of section 104, 106, 108 may allow for personal hygiene device 100 to be folded for more convenient storage and transportation, as would be understood by a person having ordinary skill in the art. In such embodiments, handle section 104 and attachment section 108 may fold adjacent opposite faces of spacing section 106, as shown in exemplary FIG. 2. Alternatively, spacing section 106 may include a cavity capable of receiving folded handle section 104 and folded attachment section 108. The device 100 may be capable of being used ambidextrously. For example, the orientation of the tool may be adjusted if necessary or the tool may be flipped over if necessary for use in a different hand. The handle section 104 and attachment section 108 may optionally include features capable of use in various orientations, including those conducive for left-handed or right-handed operation.

In an exemplary embodiment, spacing section 106 may be sized to provide a longer reach for the personal hygiene device 100. The length of spacing section 106 may vary as would be understood by a person having ordinary skill in the art. A personal hygiene device 100 may come in a variety of sizes, including length, width, and height, to accommodate users of varying sizes or to improve effectiveness for particular uses. In an exemplary embodiment, the handle section 104, spacing section 106, and attachment section 108 may be approximately the same length. In alternative exemplary embodiments, sections 104, 106, 108 may be of differing lengths.

In some exemplary embodiments, at least one clip attachment 120 may be disposed on attachment section 108. Clip attachment 120 may optionally be a hinged clip, such that the mouth of the clip can be opened to allow the insertion of material 122. In some embodiments, the clip may include teeth for gripping and retaining material enclosed by clip attachment 120. The teeth may be capable of gripping material 122 without tearing. In a further exemplary embodiment, at least one clip attachment 120 may be disposed on opposing faces of attachment section 108. A clip attachment 120 may be capable of engaging a desired material 122. In an exemplary embodiment, a desired material 122 may include toilet tissue, wipes, rags, washcloths, or other material as would be understood by a person having ordinary skill in the art. Material 122 may simply be secured by clip attachment 120 or may be folded or wrapped around an end of attachment section 108 and secured by clip attachment 120, as shown in exemplary FIG. 3. In some further embodiments where material 122 includes a wash cloth, the cloth may be simply draped over the front end of the tool, as shown in exemplary FIG. 16. The cloth may be draped over the tool over the hook and loop type fastener 130 for added support, holding it in place while in use. The cloth may be wet, soap or lotion may be added, and the cloth may be cleaned and reused, as would be done during normal use.

Figure 1:
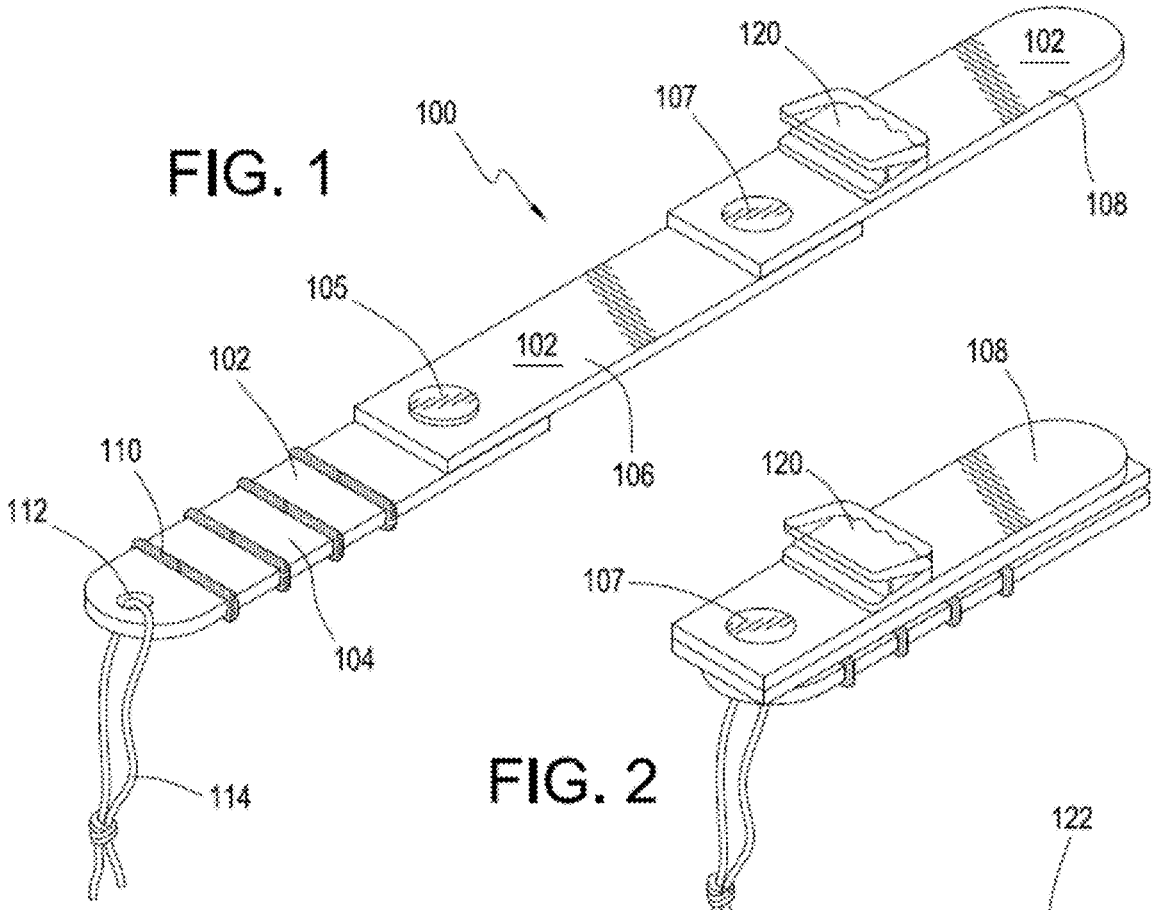

An exemplary personal hygiene device, as shown in exemplary FIG. 1, may be used as follows. A user may fold at least one section of bathroom tissue, wrap the tissue over the attachment section 108 and clip the tissue into place using a clip attachment 120. A user may then grip the handle section 104 and wipe a desired body location, such as the rectal area, with the tissue affixed to the attachment section 108. Wiping may be performed in a variety of motions from the front or rear, as desired by a user. After using, the soiled tissue may be unclipped and disposed of as desired. The process may be repeated. In some embodiments, a user may then clean the hygiene device 100 using a variety of cleaners, including, but not limited to, a sanitizing wipe, soap, water, and/or a brush.

Now referring to exemplary FIGS. 4-6, material 122 may include a tissue sleeve 400, which may be specially designed for use with personal hygiene device 100. A tissue sleeve 400 may be shaped to fit over the end of an attachment section 108 of personal hygiene device 100. Tissue sleeve 400 may be substantially pocket-like and may be sized to fit over the attachment section 108 of a personal hygiene device 100. In an exemplary embodiment, a tissue sleeve 400 may include a fastener tab 402, such as a strip of adhesive or hook and loop type fasteners, for engaging an attachment section 108. Attachment section 108 may include correlating fasteners or a securing section for engaging the fasteners of tissue sleeve 400. Tissue sleeve 400 may also be secured by clip attachment 120. In some exemplary embodiments, tissue sleeve 400 may include a flap 404. Flap 404 may be used to facilitate removing tissue sleeve 400 from elongated member 102. Fastener tab 402 may also be used as a pull-up removable tab for discarding a used tissue sleeve. In some further embodiments, a string or other attachment may be added to facilitate removal of tissue sleeve 400. Tissue sleeve 400 may optionally be moistened or coated with a cleansing product. Tissue sleeve 400 may be disposable. An exemplary tissue sleeve may be flushable, or biodegradable. In some exemplary embodiments, tissue sleeve 400 may come in a tissue sleeve envelope 410. Tissue sleeve envelope 410 may keep tissue sleeves 400 fresh prior to use. Tissue sleeve envelope 410 may also be used to discard soiled tissue sleeves 400 after use. Tissue sleeve envelope 410 may be resealable to hygienically secure soiled tissue sleeves for safe disposal in ordinary trash.

Now referring to exemplary FIGS. 7-15, a variety of attachments 140, 142, 144, 150 may be affixed to attachment section 108. Attachments may include attachments for applying creams or ointments, attachments for applying powder, scrubbing attachments, massaging scrubber attachments, sponge attachments, nylon netting scrubber attachments, brush attachments, and other attachments as would be understood by a person having ordinary skill in the art. Some attachments may be disposable, while others may be washable for repeated use. In some exemplary embodiments, an attachment pad 130 may be used to secure the attachments. Attachment pad 130 may be used in place of or in addition to clip attachment 120. In an exemplary embodiment, attachment pad 130 may include a fastener 132, such as adhesive or hook and loop type fasteners, on its surface. The fastener 132 may engage a corresponding fastener 134 or fastening area on an attachment. A fastener disposed on an attachment may alternatively engage attachment pad 130 as a fastening area. In exemplary embodiments where fasteners 132 or 134 are adhesives, the adhesives may be easily removed or reusable to facilitate repeated attaching and detaching of attachments, as would be understood by a person having ordinary skill in the art. In some further exemplary embodiments, a material 122 (shown in FIGS. 3-3A) may be secured to device 100 by engaging fastener 132. For example, fastener 132 may be a hook and loop type fastener and material 122 may be draped over the face of attachment section 108, such that the material 122 engages fastener 132.

As shown in exemplary FIG. 8, one exemplary attachment may include a soft rubber sleeve attachment 140 having small bumps or ridges. The rubber sleeve attachment may be used for scrubbing, applying creams or ointments, or any other desired use as would be understood by a person having ordinary skill in the art. Other exemplary attachments may include a powder puff attachment 142, as shown in exemplary FIGS. 10 and 12. Powder puff attachment 142 may include a corresponding fastener 134. An exemplary powder puff attachment 142 may be made of cotton or batting material and may be used to apply powders in hard to reach areas, such as but not limited to talcum powder or baby powder. Yet another exemplary attachment may include a scrubber 144, as shown in FIGS. 9 and 11. A scrubber 144 may include a corresponding fastener 134 for affixing to fastener 132 on device 100. Scrubber 144 may be a nylon netting scrubber or brush, as would be understood by a person having ordinary skill in the art.

Now referring to exemplary FIGS. 13-15, a suppository insertion device 150 may be used on personal hygiene device 100. The suppository insertion device 150 may have a base member 154, a guiding member 156, and a collapsing joint 158 connecting the base member 154 and guiding member 156. Base member 154 and guiding member 156 may be substantially parallel. In some embodiments, collapsing join 158 may be an accordion style joint. Collapsing joint 158 may allow base member 154 and guiding member 156 to be compressed together. In some embodiments, base member 154 and guiding member 156 may be a single, folded length of material and collapsing joint 158 may be adapted from the material, as would be understood by a person having ordinary skill in the art. An insertion shaft 160 may project from a surface of base member 154 toward guiding member 156. Insertion shaft 160 may have an insertion shaft base 161, which may be wider than insertion shaft 160 and may provide support for insertion shaft 160. Guiding member 156 may have an insertion slot 162, which insertion shaft 160 may pass through. Guiding member 156 may further have a raised support ring disposed around insertion slot 162, which may support a suppository 163 to be inserted by insertion shaft 160. Insertion shaft 160 may optionally include a suppository retaining pin 165, which may be a small pin point to engage and retain a suppository on the end of insertion shaft 160. Suppository retaining pin 165 may be sized to not injure or cause discomfort to a user. Pin point 165 may be made of the same material as insertion shaft 160 and may be formed integrally with insertion shaft 160 or affixed to insertion shaft 160. Suppository insertion device 150 may optionally be made of rubber, a soft plastic material, or other material that would allow for operation of the device 150 as described. In some exemplary embodiments, insertion shaft 160 may be disposed at an angle to facilitate insertion. In an exemplary embodiment, suppository insertion device 150 may have a fastener 152, such as adhesive or hook and loop type fasteners, disposed on the surface of a base member 154. The fastener 152 may be used to affix the suppository insertion device 150 on attachment section 108. In embodiments where attachment section 108 includes fastener 132, fastener 152 may engage fastener 132.

Suppository insertion device 150 may optionally be reusable or disposable. In an exemplary disposable embodiment, the fastener 152 may be a peel-back adhesive strip. The suppository insertion device 150 may come in a resealable envelope, which may be used for sanitary disposal of a used device, as would be understood by a person having ordinary skill in the art. An exemplary reusable embodiment may be sterilized after use and returned to a carrying case, which may be a reusable, resealable envelope. A fastener 152 in an exemplary reusable embodiment, may be a hook and loop type fastener.

In operation, a user may place a suppository in the insertion slot 162. The user may then align the suppository with the rectum 164. As pressure is applied through personal hygiene device 100, collapsing joint 158 may collapse, causing guiding member 156 to move toward base member 154. As this occurs, insertion shaft 160 may push through insertion slot 162, inserting the suppository 163 in the rectum 164.

A personal hygiene device 100 may further include a carrying case. The carrying case may be sized to hold a folded personal hygiene device 100. The carrying case may be capable of being placed in a purse, pocket, or other storage location. In an exemplary embodiment, a carrying case may be made of fabric, vinyl, leather, or other similar materials, as would be understood by a person having ordinary skill in the art. The carrying case may include an interior or lining that can be easily cleaned or wiped. Similar to the device 100, the carrying case may be colored, printed, or patterned as desired. A personal hygiene device 100 may also have a storage bag. The storage bag may be an open weave mesh storage bag, which may have a drawstring closure. The bag may be mesh to allow the device to be stored when wet. The bag may further include a looped drawstring for hanging on a hook.

Referring generally to FIG. 17 an alternative embodiment of a hinge 170 for use in a personal hygiene device may be shown. The hinge 170 may have securing arms 173 that may be affixed to rotatably connected disks of a quarter-lock hinge 171. Securing arms 173 may be rotated and locked into a desired orientation. Securing arms 173 may have holes 175 disposed along the length of the securing arms 173. Sections 104, 106, 108 may be secured to securing arms 173 when hinge 170 is used in a personal hygiene device. Sections 104, 106, and 108 may be slipped over securing arms 173. Holes 175 may be used to secure sections 104, 106, and 108 to a hinge 170. In some exemplary embodiments, the material of sections 104, 106, and 108 may be molded through holes 175, as would be understood by a person having ordinary skill in the art.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A personal hygiene device comprising:

an elongated member, the elongated member having a handle section, a spacing section, and an attachment section;

a grip disposed on the handle section;

a wrist strap secured to a hole disposed in the handle section;

an attachment; and a fastener disposed on the attachment section for attaching the attachment, the fastener comprising at least one of a clip, adhesive, or hook-and-loop fastener;

wherein the handle section and spacing section are rotatably connected by a first hinge; and wherein the spacing section and attachment section are rotatably connected by a second hinge;

wherein the attachment is a suppository insertion device comprising a corresponding fastener for engaging the fastener disposed on the attachment section, and wherein the suppository insertion device further comprises a base member, a guiding member substantially parallel to the base member, and a collapsing joint connecting the base member and the guiding member, wherein an insertion shaft projects from the base member toward an insertion slot disposed in the guiding member, and wherein the guiding member further comprises a support ring disposed around the insertion slot and is configured to support a suppository.

2. The personal hygiene device of claim 1, wherein the grip further comprises a plurality of rib members disposed on the surface of the handle section.

3. The personal hygiene device of claim 1, wherein the first hinge and second hinge are configured to lock in a desired orientation.

4. The personal hygiene device of claim 1, wherein the insertion shaft is configured to pass through the insertion slot.

5. A personal hygiene device comprising:

an elongated member, the elongated member having an integrally formed handle section, a spacing section, and an attachment section;

a grip disposed on the handle section;

a wrist strap secured to a hole disposed in the handle section;

an attachment; and a fastener disposed on the attachment section for attaching the attachment, the fastener comprising at least one of a clip, adhesive, or hook-and-loop fastener;

wherein the attachment is a suppository insertion device further comprising a base member, a guiding member substantially parallel to the base member, and a collapsing joint connecting the base member and the guiding member, wherein an insertion shaft projects from the base member toward an insertion slot disposed in the guiding member, and wherein the guiding member further comprises a support ring disposed around the insertion slot and is configured to support a suppository.

6. The personal hygiene device of claim 5, wherein the grip further comprises a plurality of rib members disposed on the surface of the handle section.

7. The personal hygiene device of claim 5, wherein the attachment comprises a corresponding fastener for engaging the fastener disposed on the attachment section.

8. The personal hygiene device of claim 5, wherein the insertion shaft is configured to pass through the insertion slot.

9. The personal hygiene device of claim 8, wherein the insertion shaft further comprises a suppository retaining pin.

* * * * *